US005794842A

United States Patent [19]

Hallam

[11] Patent Number: 5,794,842

[45] Date of Patent: Aug. 18, 1998

[54] TUBULAR PACKAGING CONTAINERS

[75] Inventor: Derek Hallam, Bradford, England

[73] Assignee: Concept Packaging Limited, West Yorkshire, England

[21] Appl. No.: 542,681

[22] Filed: Oct. 13, 1995

[30] Foreign Application Priority Data

Oct. 14, 1994 [GB] United Kingdom ..... 9420724

[51] Int. Cl.[6] ..... B65D 3/22; B65D 3/28

[52] U.S. Cl. ..... 229/198.2; 229/4.5; 493/152; 493/158; 493/907

[58] Field of Search ..... 229/4.5, 198.2; 493/152–155, 158, 159, 296, 906, 907, 908

[56] References Cited

U.S. PATENT DOCUMENTS

| | | | |
|---|---|---|---|
| 2,006,952 | 7/1935 | Klein | 229/4.5 |
| 2,096,776 | 10/1937 | Annen | 493/154 |
| 3,351,259 | 11/1967 | Lee, Jr. | 229/4.5 |
| 4,036,138 | 7/1977 | Chopra et al. | 229/4.5 |
| 4,225,053 | 9/1980 | Nangle et al. | 229/4.5 |

FOREIGN PATENT DOCUMENTS

| | | | |
|---|---|---|---|
| 0007539 | 2/1980 | European Pat. Off. . | |
| 3409425 | 9/1985 | Germany | 229/4.5 |
| 2038276 | 7/1980 | United Kingdom . | |

*Primary Examiner*—Gary E. Elkins
*Attorney, Agent, or Firm*—Spencer & Frank

[57] ABSTRACT

A tubular packaging container includes a body (10) which includes a peripheral wall (34) defining top and bottom openings, at least one of which is closed by an end member. The body is formed from at least two panels (20, 30) of a suitable card material cut from flat stock. The panels are secured together in face-to-face relationship by adhesive (32) distributed across the mutually contacting faces thereof. The panels are then curved to the required shape to form a tube with marginal portions (31) of at least one of the panels secured together in overlapping relationship.

16 Claims, 6 Drawing Sheets

FIG. 1
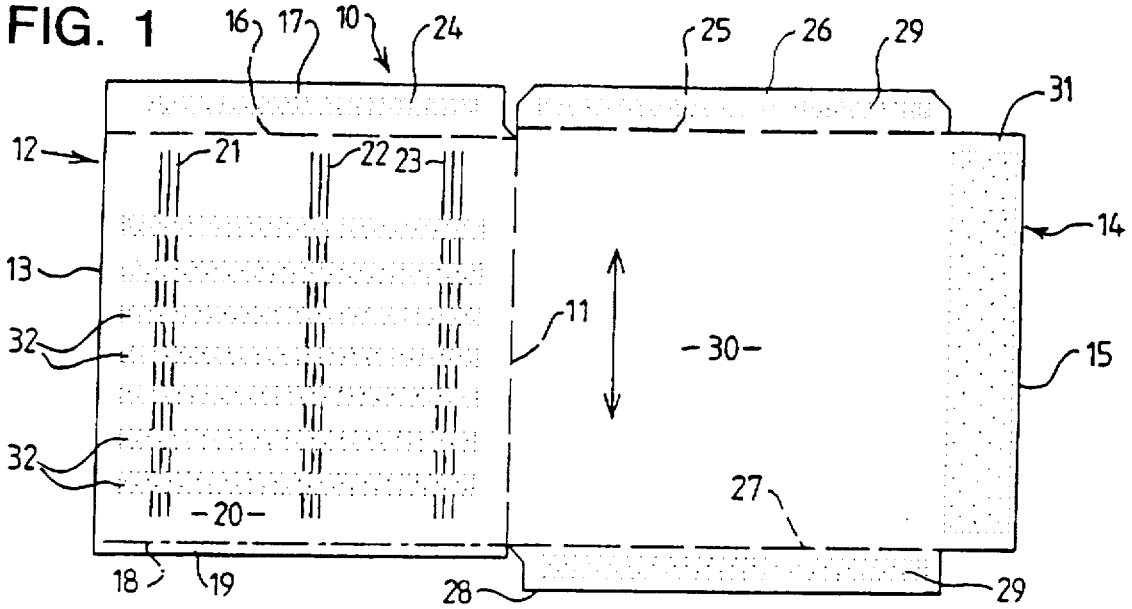
FIG. 2
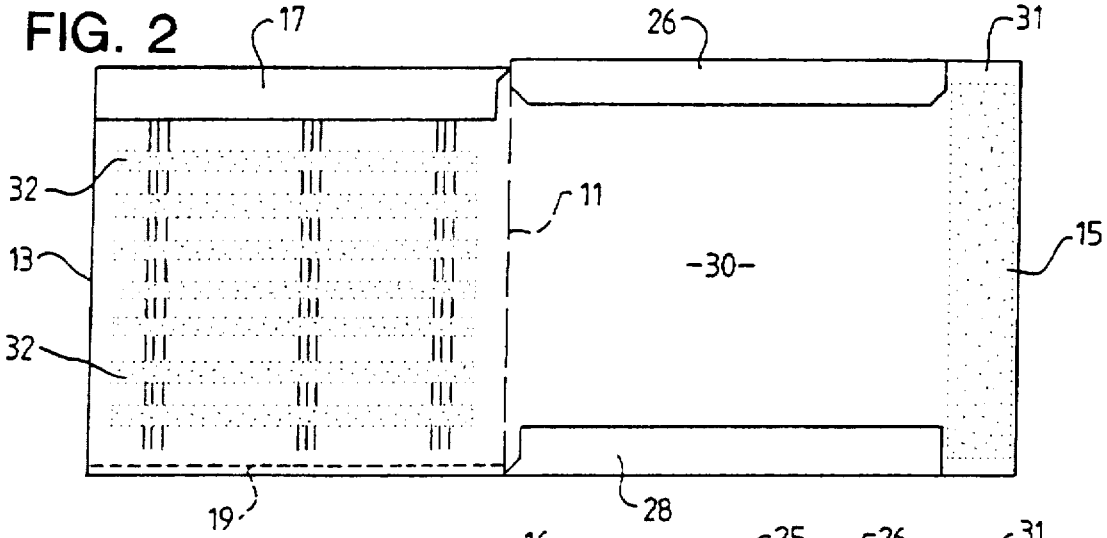
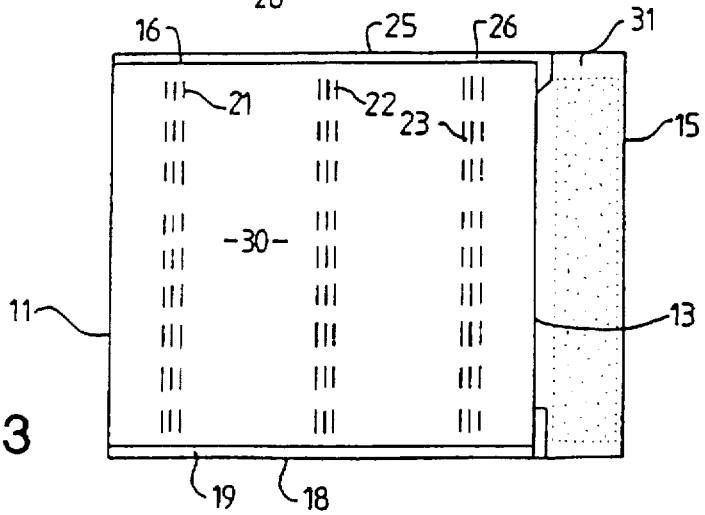
FIG. 3

FIG. 9
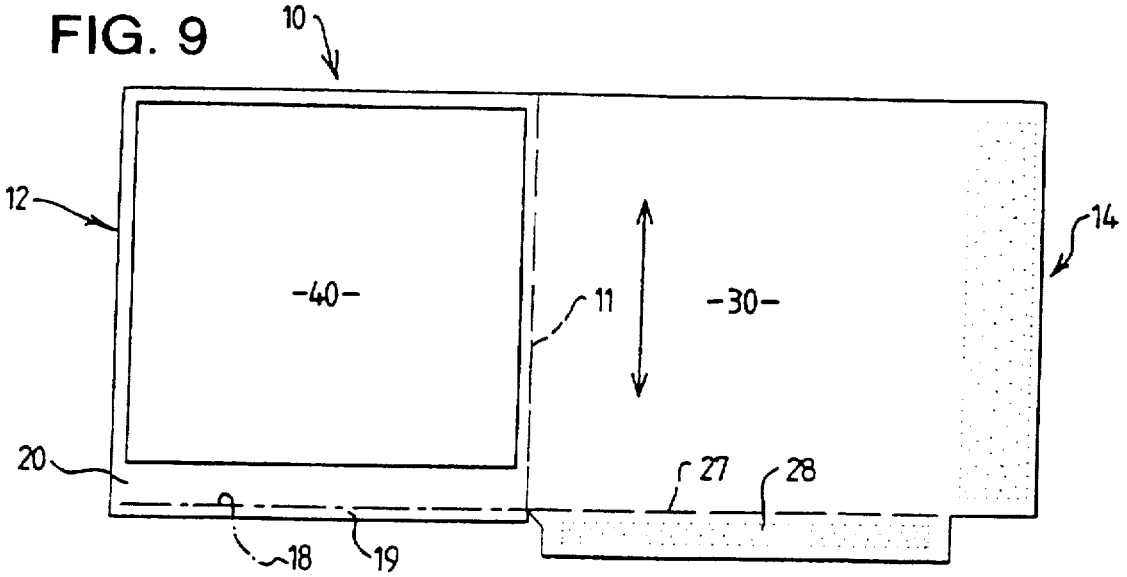
FIG. 10
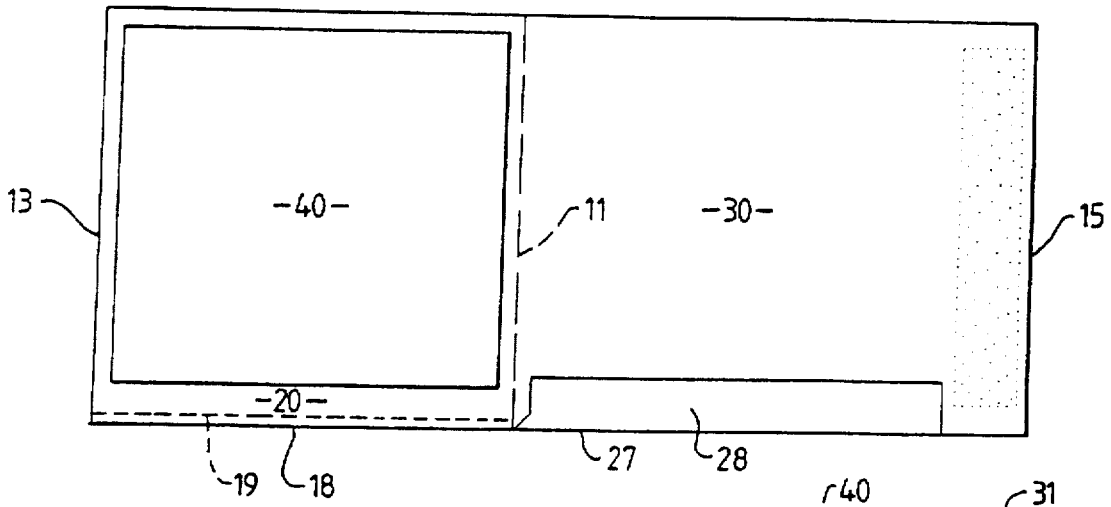
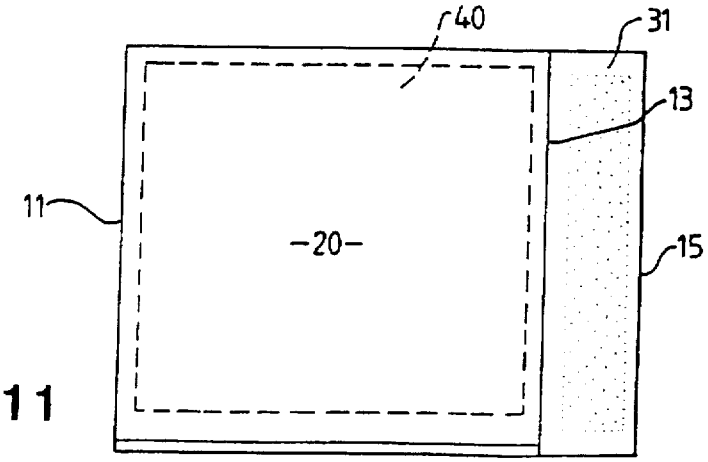
FIG. 11

TUBULAR PACKAGING CONTAINERS

FIELD OF THE INVENTION

This invention relates to tubular packaging containers of the kind comprising a body which includes a peripheral wall defining top and bottom openings, at least one of which is suitable for closure by an end member.

BACKGROUND TO THE INVENTION

Traditionally, such tubular packaging containers are formed by wrapping several strips of a suitable card material helically around a former whilst securing the strips together adhesively to form a continuous tube, which is then severed into individual lengths to form the bodies of individual containers.

Alternatively, tubes for tubular packaging containers can be manufactured by convolute winding in which a continuous strip of board is adhered to itself as it is wound 3 or 4 times around a mandrel or former.

Another method of manufacturing tubes for tubular packaging containers is to use a single relatively thick layer of (normally) card which can be wrapped around a former in a single thickness configuaration and glued to itself in an overlapping portion. In this method, the tube is shaped around a former or mandrel with the grain running perpendicular to the longitudinal axis of the tube.

These types of construction have a number of disadvantages which render them less than entirely acceptable for many applications. In particular, in the helical wrapping method the lines along which adjacent turns of the helically wrapped strips meet can be unsightly. Further, such a construction is effectively limited to the formation of tubular bodies of substantially circular cross-section, i.e. cylindrical tubes. In each of the above described methods the end edges of the body inevitably are afforded by raw cuts through the material, and it is difficult to achieve a high quality surface finish, externally or internally, without the addition of one or more further layers of decorative material.

It is an object of the present invention to provide a tubular packaging container in which a substantially rigid body is formed from a flat blank which is folded to the required shape and adhesively secured in generally the same manner as traditionally employed for the construction of flat-sided cartons.

Utilising such a method of construction enables carton manufacturers to produce tubular packaging containers from flat blanks which can be cut on conventional machinery.

SUMMARY OF THE INVENTION

According to the invention we provide a tubular packaging container comprising a body which includes a peripheral wall defining top and bottom openings, at least one of which is suitable for closure by an end member, wherein the body is formed from at least two panels of a suitable card material cut from flat stock and curved to the required shape to form a tube with marginal portions of at least one of said panels secured together in overlapping relationship, said panels also being secured together in face-to-face relationship by adhesive distributed across the mutually contacting faces thereof.

Where the body is formed from two such panels, most conveniently the two panels are formed by folding a single flat blank, although the two panels may be formed from separate pieces of material if desired.

In addition to the simplicity of the method of construction, a tubular packaging container in accordance with the invention has the further advantage that it can be formed from card material having an appropriate finish on one face, so obviating the need for the application of an additional, decorative outer layer. Where the two panels are formed from a single blank, it will be appreciated that the finished face of the material will form the exposed faces of the external and internal panels, i.e. the outer and inner faces of the tubular body. Where different internal and external finishes are required, the two panels can be formed from separate pieces of material as appropriate.

Where required, one or more additional panels may be sandwiched between the internal and external panels.

In accordance with a preferred feature of the invention, marginal portions of only the external panel are secured together adhesively in overlapping relationship to form the tubular body, whilst corresponding end edges of the internal panel are brought into abutting relationship to define the peripheral dimension of the tubular body.

Either or both of the external and internal panels may be formed with foldable auxiliary panels at the top and/or bottom edges thereof so that the end edges of the panel do not comprise raw cuts.

The height of the external and internal panels need not be the same and in this way an internal or external ledge can be formed, for example for cooperation with an appropriate end member.

The invention also resides in a method of manufacturing the body of a tubular packaging container including the steps of cutting from substantially flat stock of a suitable card material at least two panels, curving said panels to the required shape to form a tube with marginal portions of at least one of said panels secured together in overlapping relationship, and adhesively securing the panels together face-to-face relationship by means of adhesive distributed across the mutually contacting faces thereof.

Two of said panels may be formed by folding a single flat blank into face-to-face relationship, and one or more additional panels may be sandwiched between them.

The panels are preferably curved in a direction transverse to the direction of grain of the card material, and the adhesive may be distributed substantially uniformly across the entire face-to-face contacting areas of the panels, either as a continuous adhesive layer or a discontinuous layer.

Where the adhesive material is applied discontinuously, it is preferred that the adhesive material extends continuously in a direction transverse to the grain of the material, e.g. in substantially uninterrupted bands which may be spaced apart in the direction of the grain of the material. However, it may also be possible to employ the adhesive material in the form of an array of closely spaced, uniformly distributed spots.

BRIEF DESCRIPTION OF THE DRAWINGS

These and other features of the invention will now be described by way of example with reference to the accompanying drawings wherein:

FIG. 1 shows a flat blank for the construction of a first embodiment of tubular packaging container in accordance with the invention;

FIG. 2 shows the blank of FIG. 1 with auxiliary panels thereof folded relative to the main panels;

FIG. 3 shows the blank of FIG. 2 with the main panels folded into face-to-face relationship prior to the curving of the folded blank to form a tubular body;

FIG. 9 shows a flat blank for the construction of a third embodiment of tubular packaging container in accordance with the invention and with an additional panel secured thereto;

FIG. 10 shows the blank of FIG. 9 with auxiliary panels thereof folded relative to the main panels;

FIG. 11 shows the blank of FIG. 10 with the main panels folded into face-to-face relationship prior to the curving of the folded blank to form a tubular body.

DESCRIPTION OF THE PREFERRED EMBODIMENTS

Figure 4:
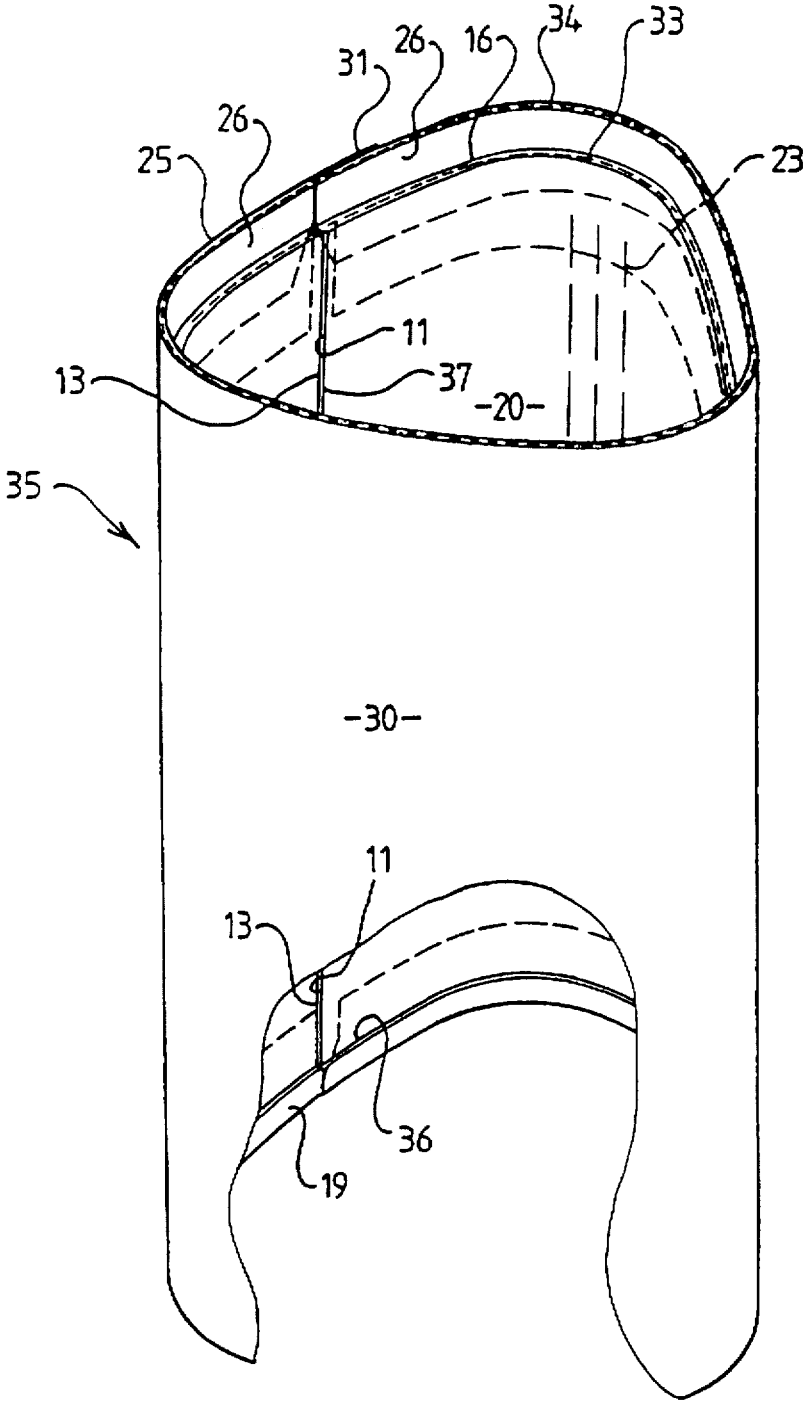
FIG. 4 is a perspective view of a tubular body formed from a folded blank of FIG. 3.
Figure 5:
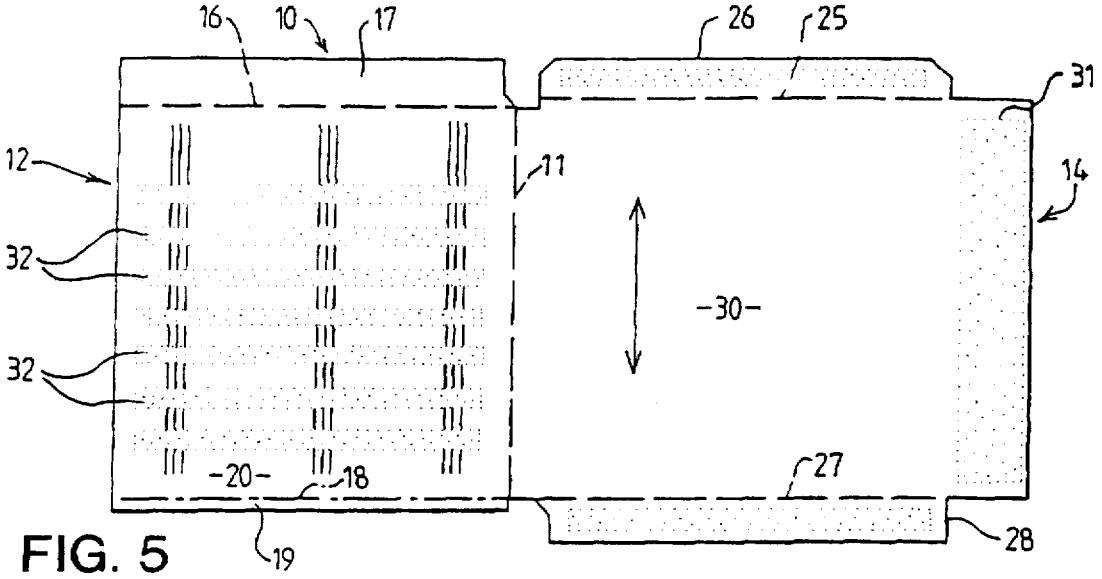
FIG. 5 shows a flat blank for the construction of a second embodiment of tubular packaging container in accordance with the invention.
Figure 6:
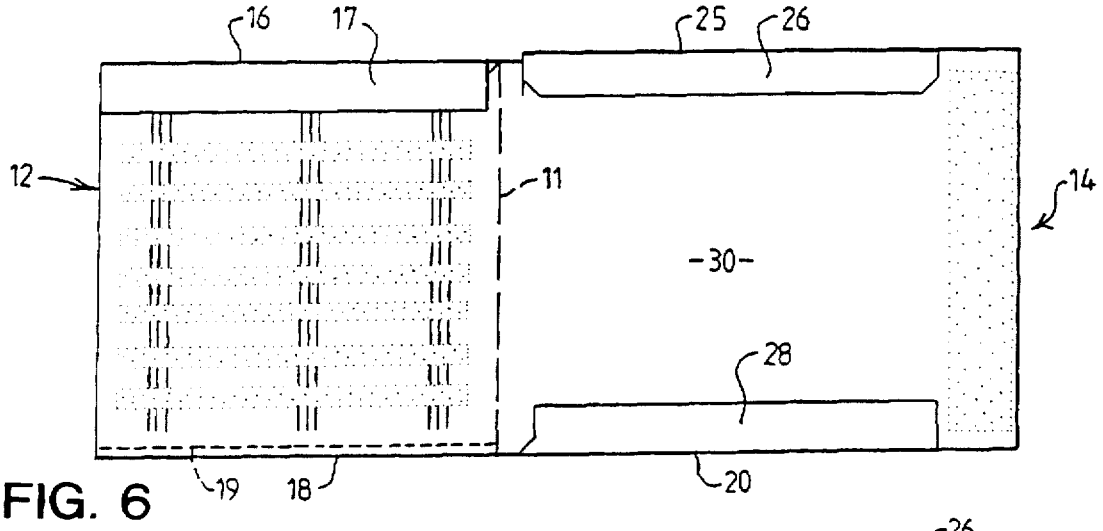
FIG. 6 shows the blank of FIG. 5 with auxiliary panels thereof folded relative to the main panels.
Figure 7:
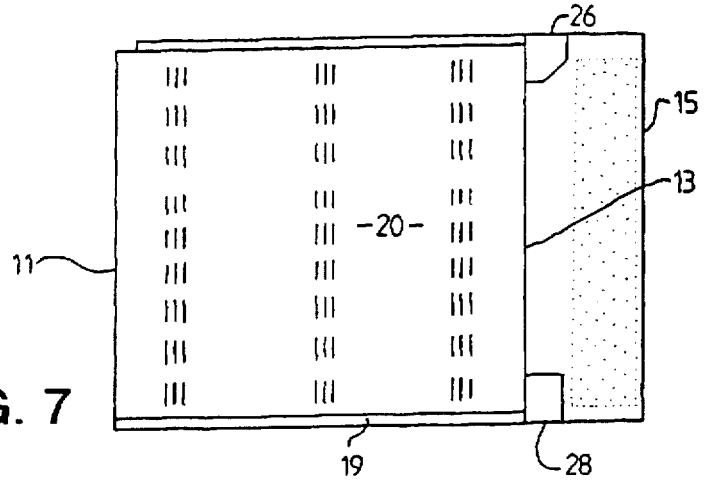
FIG. 7 shows the blank of FIG. 6 with the main panels folded into face-to-face relationship prior to the curving of the folded blank to form a tubular body.

Referring firstly to FIG. 1, the blank 10 shown therein is of generally rectangular form with a medial fold line 11 which runs parallel to the grain of the board as indicated by the double-headed arrow and divides the blank into an inner portion 12 which extends between the fold line 11 and one free edge 13 of the blank and an outer portion 14 which extends between the fold line 11 and the other free edge 15. An upper crease line 16 across the entire width of the inner portion 12 defines an upper auxiliary panel 17, and a lower continuous score line 18 defines a lower auxiliary panel 19. The fold line 11, crease line 16, score line 18 and free edge 13 define in combination the periphery of a rectangular, inner main panel 20.

In the illustrated embodiment, three groups of crease lines 21, 22 and 23 extend parallel to the fold line 11 to facilitate subsequent shaping of the panel 20 as hereinafter described.

A strip of adhesive 24 is applied to the upper auxiliary panel 17 whereby the latter can be folded about crease line 16 so as to be secured to the face of the inner main panel 20 in the manner as illustrated in FIG. 2. Likewise, the score line 18 enables the lower auxiliary panel 19 to be folded so as to lie against the opposite face of the panel 20, again as illustrated in FIG. 2.

The outer portion 14 of the blank 10 is formed with an upper crease line 25 which defines an upper auxiliary panel 26 and a lower crease line 27 which defines a lower auxiliary panel 28. Lines of adhesive 29 applied to the auxiliary panels 26 and 28 enable them to be folded into overlapping relationship with the adjacent marginal portions of the outer main panel 30 as defined between the fold line 11, crease lines 25, 27 and the free edge 15. As can be seen, the auxiliary panels 26 and 28 correspond in length to the width of the inner main panel 20, whereas the main outer panel 30 is of somewhat greater width so as to afford an adhesive-coated overlap portion 31 outwardly of the ends of the auxiliary panels 26 and 28.

Closely spaced bands of adhesive 32 are applied to the main inner panel 20 so as to extend in a direction transverse to the line of the grain over substantially the entire exposed area of the panel 20. The adhesive bands 32 may be applied at the same time as the adhesive strips 24 and 29 or subsequently if a different type of adhesive is to be used. The adhesive can, for instance, be hot, cold, PVA, animal or other adhesive.

After the auxiliary panels 17, 26 and 28 have been adhesively secured to the panels 20 and 30, and the auxiliary panel 19 has been folded over in the manner illustrated in FIG. 2, the blank 10 is then folded about line 11 to bring the adhesive coated face of panel 20 into face-to-face relationship with the outer main panel 30, as shown in FIG. 3. It will be observed that the overlap portion 31 of the outer main panel 30 is not covered by the inner main panel 20, but instead the free edge 13 of the latter is spaced from and parallel to the free edge 15 of the outer main panel. Whilst the overlap portion 31 as illustrated comprises a single thickness of material, to avoid exposure of the raw edge at the free edge 15, it will be appreciated that the overlap portion 31 may comprise two thicknesses of material obtained by folding the panel 30 about a line parallel to the free edge 15.

Before the bands of adhesive 32 cure, the composite panel 20/30 is curved, if necessary around an appropriate former, to bring the folded edge 11 thereof into abutting relationship with the free edge 13 of the main inner panel 20, so that a marginal portion of the composite panel is brought into register with the overlap portion 31 of the outer panel 30, in the manner illustrated in FIG. 4, the overlap portion 31 then being adhesively secured in place, preferably by means of lithographically printed adhesive. The reverse side of the panel 30 can carry an ultrasonically sealable varnish to assist adhesion to the overlap portion 31.

Because the adhesive applied in the bands has not cured when the composite panel 20/30 is curved to the desired sectional shape of the tubular body, the inner and outer panels are free to slide relative to each other, if necessary, due to their different circumferential dimensions. The tubular body remains flexible until the adhesive has cured sufficiently to impart a substantial degree of rigidity. For this reason it is important that the adhesive is distributed over the contacting surface of the inner and outer panels 20, 30 and that when the adhesive is cured the result is a laminate which is substantially rigid. This is a particular advantage of the present invention since it greatly increases the rigidity of the container compared with previous comparable designs.

As can be seen, the upper edge of the inner main panel 20, as defined by fold line 16, in combination with the in-turned auxiliary panel 26 of the outer main panel 30 forms a ledge 33 which is spaced downwardly from the top edge 34 of the tubular body 35 thereby formed. The ledge 34 may be used to locate any appropriate end closure member (not shown).

In a similar manner, the in-turned auxiliary flange 19 at the lower edge of the inner main panel 20 affords an internal ledge 36 on which any appropriate bottom end closure member may rest.

In the illustrated embodiment, the groups of score lines 21, 22 and 23 serve to enable the composite panel 20/30 to be curved into a pseudo-triangular configuration comprising three slightly curved wall portions united by rounded "corner" portions at positions corresponding to respective groups of crease lines 21, 22 and 23.

The board material from which the blank 10 is formed preferably includes one face having an appropriate "finish" applied thereto, and one raw or un-finished face, and in this case the uppermost face of the blank illustrated in FIG. 1 is the unfinished face, so that when the blank is folded as illustrated in FIG. 3 the finished face of the material provides the external of the outer panel 30 and the internal face of the inner panel 20 in the formed body 35. The finish applied to the material may be of any appropriate kind including sealing or glazing, foil lamination etc.

Whilst in the embodiment illustrated in FIGS. 1 to 4 the height of the inner main panel 20 is somewhat less than that of the outer main panel 30, it will be appreciated that the two panels may be of the same height where it is not required to form an internal ledge at the top of the body. Further, it would be possible for the height of the outer main panel 30 to be less than that of the inner main panel 20 so as to provide an external ledge at the top of the body 35 where, for example, the container is to be closed by means of an end cap having an external flange.

Likewise, some or all of the auxiliary panels 17, 19, 26 and 28 may be omitted where it is not desired to avoid raw end edges at the top and bottom of the body.

Figure 8:
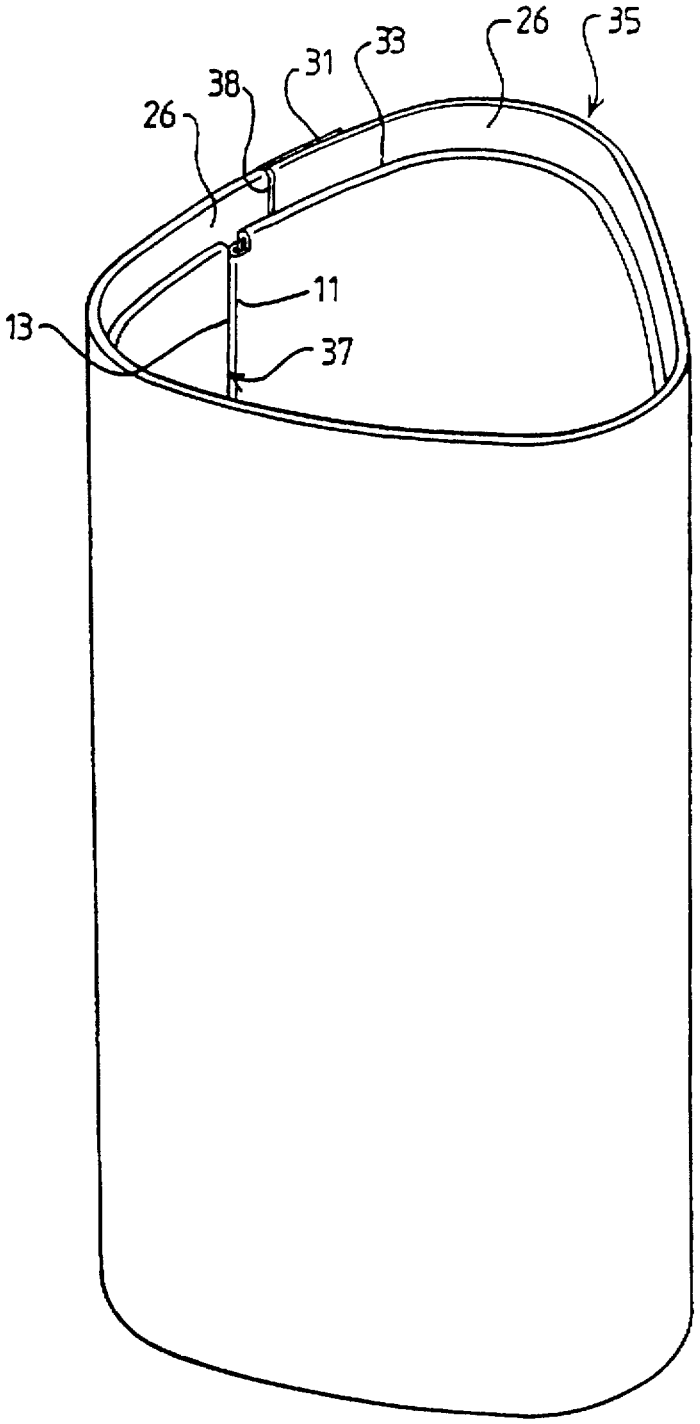
FIG. 8 is a perspective view of a tubular body formed from a folded blank of FIG. 7.
Figure 12:
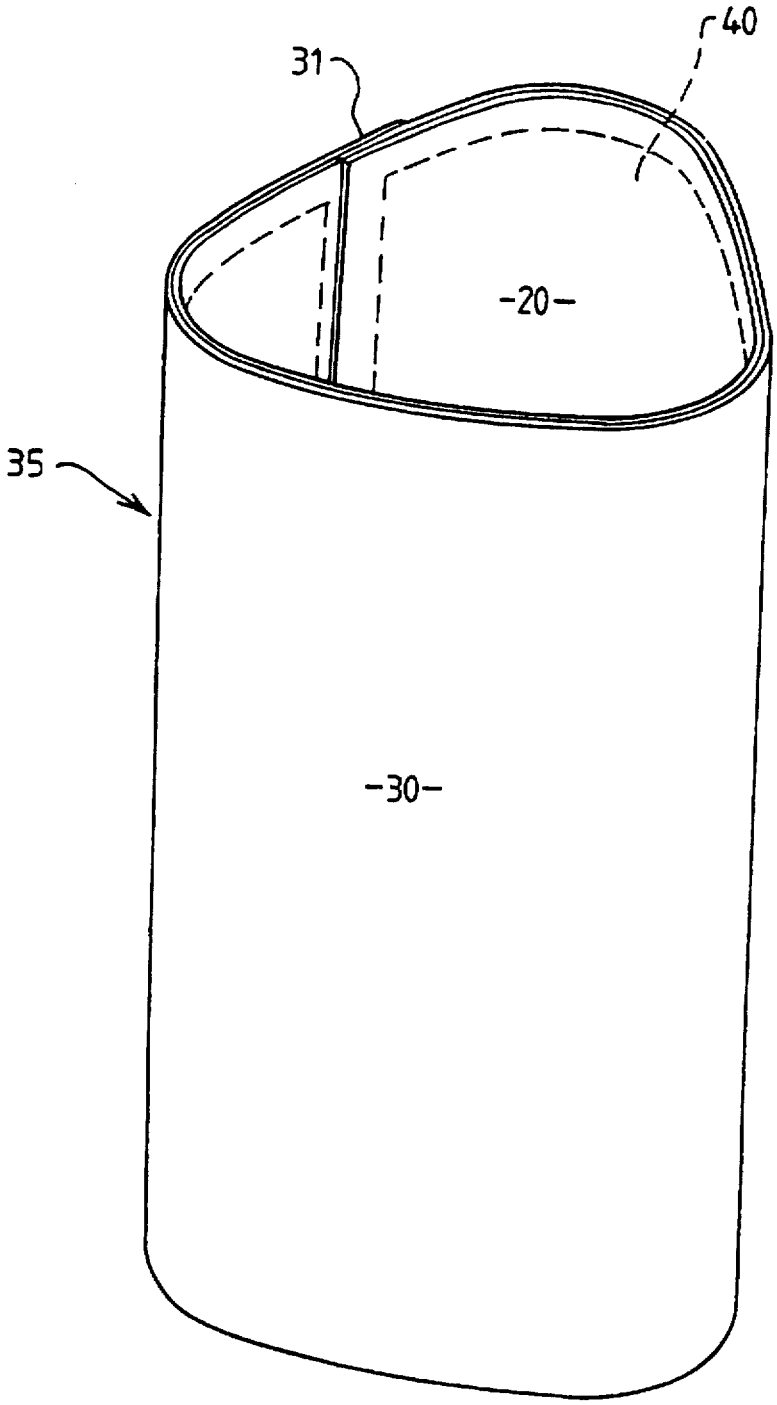
FIG. 12 is a perspective view of a tubular body formed from a folded blank of FIG. 11.

It will be observed from FIG. 4 that the joint 37 formed by the abutment of the free edge 13 of the inner panel 20 with the folded edge 11 is in register with the abutting ends of the upper auxiliary panel 26, whereas in the embodiment illustrated in FIGS. 5 to 8 this is avoided by increasing the width of the outer main panel 30 somewhat at the fold line 11 so as to move the upper and lower auxiliary panels 26 and 28 away from the fold line 11. All other features of the embodiment illustrated in FIGS. 5 to 8 are identical with those of the previously described embodiment and will therefore not be described in further detail. However, as seen in FIG. 8 the joint 38 between the abutting ends of the upper auxiliary panel 26 of the outer panel 30 is displaced relative to the joint 37 where the free edge 13 of the inner panel 20 abuts the folded edge 11.

This arrangement is particularly desirable where the tubular body includes inturned auxiliary panels as illustrated because the aligned joints 37, 38 afford a line of weakness whereby the material tends to form a "peak", i.e. lie at a shallow angle rather than forming a continuous smooth transition at the joint line. This effect is greater due to the multiple thickness of material arising from the inturned auxiliary panels. However, by staggering the joints 37 and 38 as shown in FIG. 8 this tendency is significantly reduced with the result that a smooth transition can be obtained at the joints.

Whilst it is particularly convenient in the above cases to form the main inner and outer panels 20 and 30 from a single flat blank 10, it will be appreciated that the main panels 20 and 30 may be formed from separate blanks secured together in face-to-face relationship. It will also be appreciated that one or more intermediate panels may be sandwiched between the inner and outer panels 20 and 30, and one such arrangement is illustrated in FIGS. 9 to 12. The blank illustrated in FIGS. 9 to 11 is generally similar to blank 10 previously described and the same reference numerals are used for equivalent parts. However, it will be observed that the upper auxiliary panels are, in this case, omitted.

Before the inner main panel 20 is folded about line 11 into face-to-face relationship with the outer main panel 30, an intermediate panel 40 is located in face-to-face relationship to the inner main panel 20 by means of bands of uncured adhesive as in the FIG. 1 embodiment. Further such adhesive may, if necessary, be applied to the intermediate panel 40 so that this can be adhered to the outer main panel 30, but such additional adhesive may not in all cases be necessary between the intermediate panel 40 and the outer main panel 30 where the latter is integrally united with the inner main panel at the fold line 11, it being sufficient for the overlap 31 to be secured adhesively.

The cross-sectional shape of the tubular body formed in accordance with the invention can, of course, differ from that illustrated. Thus, it is possible to form a circular-section cylinder, an oval-section tube, or for example a pseudo-square form, in addition to the pseudo-triangular form as illustrated.

Whilst the form of body is preferably defined on a former or mandrel on which the curved blank is held until the adhesive 32 is cured, the use of such a former or mandrel may not always be necessary.

Once formed, the tubular body is sufficiently rigid as to be generally shape-holding, and the completion of the container by the addition of appropriately shaped end closers provides further strength.

The design is suitable to both hand and mechanised make-up.

The card can be covered or treated and need only be predominantly card, typically cartonboard.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A tubular packaging container comprising a body which includes a peripheral wall defining top and bottom openings, at least one of which is suitable for closure by an end member, wherein the body is formed from at least two panels of a suitable card material cut from flat stock and shaped to form a tube with marginal portions of at least one of said panels secured together in overlapping relationship, said panels also being secured together in face-to-face relationship by adhesive distributed across the mutually contacting faces thereof, in which marginal portions of only the external panel are glued together adhesively in overlapping relationship to form the tubular body, whilst corresponding end edges of the internal panel are brought into abutting relationship to define the peripheral dimension of the tubular body.

2. A tubular packaging container according to claim 1, in which the body is formed from two such panels, which panels are formed by folding a single flat blank.

3. A tubular packaging container according to claim 1, in which one or more additional panels is or are sandwiched between the internal and external panels.

4. A tubular packaging container according to claim 1, in which the external panels is formed with a foldable auxiliary panel at the top edge thereof.

5. A tubular packaging container according to claim 1, in which the external panel is formed with a foldable auxiliary panel at the bottom edge thereof.

6. A tubular packaging container according to claim 1, in which the internal panel is formed with a foldable auxiliary panel at the top edge thereof.

7. A tubular packaging container according to claim 1, in which the internal panel is formed with a foldable auxiliary panel at the bottom edge thereof.

8. A tubular packaging container according to claim 1, in which the two panels of card material are curved to a predetermined shape to form the tube.

9. A method of manufacturing the body of a tubular packaging container including the steps of cutting from substantially flat stock of a suitable card material at least two panels, adhesively securing the panels together in face-to-face relationship by means of adhesive distributed across the mutually contacting faces thereof, shaping said panels to a predetermined shape to form a tube, and securing together adhesively marginal portions of only the external panel in overlapping relationship to form the tubular body, whilst corresponding end edges of the internal panel are brought into abutting relationship to define the peripheral dimensions of the tubular body.

10. A method of manufacturing the body of a tubular packaging container according to claim 9 in which two of said panels are formed by folding a single flat blank into face-to-face relationship.

11. A method of manufacturing the body of a tubular packaging container according to claim 10, in which one or more additional panels are sandwiched between them.

12. A method of manufacturing the body of a tubular packaging container according to claim 9, in which there is a direction of grain of the card material and the panels are curved in a direction transverse to the direction of grain of the card material.

13. A method of manufacturing the body of a tubular packaging container according to claim 12, in which the adhesive is distributed substantially uniformly across the entire face-to-face contacting areas of the panels as a continuous adhesive layer.

14. A method of manufacturing the body of a tubular packaging container according to claim 12, in which the adhesive is distributed substantially uniformly across the entire face-to-face contacting areas of the panels as a discontinuous layer.

15. A method of manufacturing the body of a tubular packaging container according to claim 14, in which the card material has a grain direction and adhesive material extends continuously in a direction transverse to the grain direction of the card material.

16. A method of manufacturing the body of a tubular packaging container according to claim 9, further comprising the step of curving said panels to a predetermined shape to form the tube.

* * * * *